US005873952A

United States Patent [19]

Hall et al.

[11] Patent Number: 5,873,952

[45] Date of Patent: Feb. 23, 1999

[54] PROCESS FOR FORMING A PROTECTIVE COATING ON ZINCIFEROUS METAL SURFACES

[75] Inventors: James R. Hall, Rochester; Thomas J. Prescott, Troy, both of Mich.

[73] Assignee: Henkel Corporaiton, Gulph Mills, Pa.

[21] Appl. No.: 896,238

[22] Filed: Jul. 17, 1997

Related U.S. Application Data

[60] Provisional application No. 60/024,207 Aug. 20, 1996.

[51] Int. Cl. [6] ..... C23C 22/48

[52] U.S. Cl. ..... 148/247; 148/273; 148/279

[58] Field of Search ..... 148/247, 273, 148/279

[56] References Cited

U.S. PATENT DOCUMENTS 5,344,504 9/1994 Deck et al. ..... 148/243

FOREIGN PATENT DOCUMENTS

WO85/05131 11/1985 WIPO .

*Primary Examiner*—David A. Simmons
*Assistant Examiner*—Robert R. Koehler
*Attorney, Agent, or Firm*—Ernest G. Szoke; Wayne C. Jaeschke; Norvell E. Wisdom, Jr.

[57] ABSTRACT

More nearly consistent quality of the coatings formed by contacting a zinciferous surface with an aqueous liquid treatment composition comprising water, transition metal cations, and fluorometallate anions, and, optionally, acidity adjustment agents can be achieved by (I) measuring the pH value of and the concentrations of transition metal cations and of fluorometallate anions in the treatment composition as it is used, (II) removing a specified fraction of the treatment composition from contact with the remainder of the treatment composition, and (III) adding one or more suitable replenisher compositions to the treatment composition, in order to maintain the measured pH and concentration values within specified ranges.

20 Claims, No Drawings

PROCESS FOR FORMING A PROTECTIVE COATING ON ZINCIFEROUS METAL SURFACES

CROSS-REFERENCE TO RELATED APPLICATIONS

Priority under 35 U.S.C. § 119(e)(1) from Provisional Application Ser. No. 60/024,207 is claimed for this application filed Aug. 20, 1996.

STATEMENT REGARDING FEDERALLY SPONSORED RESEARCH OR DEVELOPMENT

Not Applicable

BACKGROUND OF THE INVENTION

This invention relates to providing zinciferous metal surfaces, i.e., surfaces of a metallic material that is at least 55% by weight zinc, with a corrosion protective coating by contacting the zinciferous surfaces with an aqueous acidic treatment composition containing fluorometallate anions and transition metal cations.

The general type of treatment compositions used in this invention was disclosed in Patent Cooperation Treaty International Publication WO/85/05131. Little attention was paid in that publication to maintenance of the treatment composition during extended use. It is now known, however, that zinc ions dissolve from the metal surface being treated and accumulate in used aqueous acidic treatment compositions of this type, thereby altering their composition. U.S. Pat. No. 5,344,504 of Sep. 6, 1994 to Deck et al. teaches that certain treatment compositions of this type operate satisfactorily even with zinc ions concentrations up to 30 grams per liter (hereinafter usually abbreviated as "g/L") and recommends operating processes using such compositions to treat zinciferous surfaces with little or no overflow, in order to minimize pollution problems. However, it has now been observed that such a method of operation leads to variations in the quality of the coatings produced and that such variations are unacceptable for some commercial operations.

A major object of the present invention is to provide an improved process for treating zinciferous surfaces with compositions containing transition metal cations and fluorometallate anions so as to minimize variations in the quality of the protective coatings formed thereby. Other objects will be apparent from the description below.

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, mutatis mutandis, to normal grammatical variations thereof; the description of a group or class of materials as suitable or preferred for a given purpose in connection with the invention implies that mixtures of any two or more of the members of the group or class are equally suitable or preferred; chemical descriptions of neutral materials apply to the materials at the time of addition to any combination specified in the description and/or of generation in situ in a combination by chemical reactions described in the specification, and do not necessarily preclude chemical changes to the materials as a result of unstated reaction in the combination; specification of materials in ionic form means that the materials are supplied to prepare the compositions containing them in the form of soluble substance(s) containing the ions specified and implies the presence in any composition specified to contain ionic materials of sufficient counteroins to produce electrical neutrality for the composition as a whole; any counterions thus implicitly specified preferably are selected from among other constituents explicitly specified in ionic form, to the extent possible; otherwise such counterions may be freely selected, except for avoiding counterions that act adversely to an object of the invention.

BRIEF SUMMARY OF THE INVENTION

It has been found that more nearly consistent quality of the coatings formed in a process for forming a protective coating on a zinciferous surface by contacting this surface with an aqueous liquid treatment composition comprising, preferably consisting essentially of, or more preferably consisting of, water, transition metal cations, and fluorometallate anions, and, optionally, acidity adjustment agents can be achieved by (I) measuring the pH value of and the concentrations of transition metal cations and of fluorometallate anions in the treatment composition as it is used, (II) removing a specified fraction of the treatment composition from contact with the remainder of the treatment composition, and (III) adding one or more suitable replenisher compositions to the treatment composition, in order to maintain (III.2) the pH of the composition, (III.2) the transition metal cations content of the composition, and (III.3) the fluorometallate anions content of the composition within specified ranges.

Removing, preferably repeatedly, a specified fraction of the treatment composition, and not recycling the removed portion directly back to the portion of the treatment composition that is contacted with new metal substrate surface to be protected, has been found to be important for maintaining consistent coating quality, irrespective of the concentration of any original constituent of the composition or of zinc, which dissolves into the composition during treatment. Although the invention is not limited by any theory, it is hypothesized that impurities of unknown nature accumulate in the treatment composition when it is used, or possibly even as it stands without being used, and that such impurities adversely affect the quality of coatings formed. Such adverse effects can be avoided by repeatedly discarding a set fraction of the treatment composition, and it has been found that preferred rates of discarding portions of the treatment composition in order to achieve these other purposes are sufficient to avoid any deleterious buildup of zinc ions in the treatment composition. Thus there is no need to measure or otherwise to be concerned about the concentration of zinc ions when a process according to this invention is performed. Pollution abatement for the discarded treatment composition is often needed, and can readily be performed by methods known to those skilled in the art.

BRIEF DESCRIPTION OF THE SEVERAL VIEWS OF THE DRAWING

Not Applicable

DETAILED DESCRIPTION OF THE INVENTION

After some experience with a well controlled embodiment of a process according to this invention, continuing direct measurement of the concentrations of both the transition metal cations and the fluorometallate anions in the composition often is not required, because a long-term consistent quantitative relationship between the concentrations of these two component has been found to persist. In such instances, direct measurement of only one of these concentrations is required, and the measurement of the other concentration as required by the invention can be satisfactorily accomplished by calculation from the directly measured one of these concentrations and the established quantitative relationship between them. Inasmuch as this specialized embodiment of a process according to the invention conserves time and corresponding cost, in instances where it is suitable it is also preferred. Independently, if a treatment composition according to the invention is used for more than a few hours, each of steps (I), (II), and (III) is preferably performed more than once, more preferably at regular intervals.

The transition metal cations that are a necessary component of the treatment composition used according to the invention preferably are selected from the group consisting of nickel, cobalt, copper, iron, and manganese, with nickel, cobalt, and iron preferred and nickel most preferred. These cations may be provided by dissolving a corresponding elemental metal or an alloy in a precursor composition containing a sufficient amount of a suitable acid to cause the metal to dissolve with concomitant evolution of hydrogen gas. Usually, however, these cations are more conveniently and thus more preferably supplied in the form of an oxide or a salt of the metal. Inasmuch as many anions can have a deleterious effect on the operation of a treatment composition used according to the invention, it is preferred to utilize oxides, carbonates, and/or sulfates of one of the metals named, all of which compounds contain, or produce when dissolved, anions that are generally free of harmful effects if present, as the source(s) of these cations that are a required constituent of a treatment composition used according to the invention. The entire stoichiometric equivalent as any of these cations in any source material as dissolved in a composition according to the invention or in a precursor composition for it is to be considered as part of the total transition metal cations present, irrespective of the actual degree of ionization that may occur in the composition thus formed.

Independently of their chemical nature, the total concentration of the transition metal cations dissolved in a working treatment composition according to the invention preferably is at least, with increasing preference in the order given, 0.0004, 0.0006, 0.0008, 0.0010, 0.0015, 0.0020, 0.0025, 0.0030, 0.0034, 0.0038, 0.0042, or 0.0045 moles per liter (hereinafter usually abbreviated as "M/L") and independently, primarily for reasons of economy, preferably is not more than, with increasing preference in the order given, 0.050, 0.040, 0.030, 0.020, 0.015, 0.012, 0.0100, 0.0080, 0.0070, 0.0067, 0.0062, 0.0057, 0.0052, or 0.0048 M/L.

The fluorometallate anions that are also a required constituent of a treatment composition used according to the invention preferably are selected from the group consisting of $BF_4^-$, $SiF_6^{-2}$, $TiF_6^{-2}$, and $ZrF_6^{-2}$, with the latter two more preferred and fluorotitanate most preferred. Such anions may be introduced into a treatment composition according to the invention as acids or salts, with the acids usually preferred for economy and because a net acidity of the compositions is preferable as considered further below, and the entire stoichio-metric equivalent as any of the above recited fluorometallate ions in any source material as dissolved in a composition according to the invention or a precursor composition for it is to be considered as part of the fluorometallate component, irrespective of the actual degree of ionization that may occur. Independently of their chemical nature, the total concentration of the fluorometallate anions dissolved in a working treatment composition according to the invention preferably is at least, with increasing preference in the order given, 0.001, 0.002, 0.004, 0.006, 0.0070, 0.0080, 0.0085, 0.0090, 0.0095, 0.0100, 0.0105, 0.0110, or 0.0115 M/L and independently, primarily for reasons of economy, preferably is not more than, with increasing preference in the order given, 0.20, 0.15, 0.10, 0.070, 0.040, 0.035, 0.030, 0.025, 0.022, 0.019, 0.016, 0.0140, 0.0135, 0.0130, 0.0125, 0.0121, 0.0118, or 0.0116 M/L. Furthermore, independently of their actual concentrations, the concentrations of fluorometallate anions and transition metal cations preferably are such that the ratio between them is at least, with increasing preference in the order given, 0.50:1.0, 0.80:1.0, 1.20:1.0, 1.60:1.0, 1.80:1.0, 2.00:1.0, 2.10:1.0, 2.20:1.0, 2.30:1.0, 2.40:1.0, 2.45:1.0, 2.49:1.0, or 2.52:1.0 and independently preferably is not more than, with increasing preference in the order given, 10:1.0, 8.0:1.0, 6.0:1.0, 5.0:1.0, 4.5:1.0, 4.0:1.0, 3.5:1.0, 3.20:1.0, 3.00:1.0, 2.80:1.0, or 2.60:1.0.

No other constituents (except water and counterions) are necessary in a treatment composition used according to the invention, but normally at least one other substance to adjust the acidity is preferred. The pH value of a working treatment composition used according to the invention preferably is at least 2.5, 2.7, 2.9, 3.1, 3.3, 3.5, 3.60, 3.70, or 3.80 and independently preferably is not more than 5.0, 4.8, 4.6, 4.4, 4.30, or 4.20. Too low a pH value will generally result in excessive attack on the substrate being treated, so that the surface is roughened and may not develop a protective coating at all, while too high a pH will make coating formation very slow. Independently of pH, to the extent chemically possible, the Total Acid value of the treatment composition used in a process according to the invention, this Total Acid value being defined in "points" equal to the number of milliliters of 0.1 N strong alkali solution required to titrate a 10 milliliter sample of the composition to an end point of at least pH 8.2, as with phenolphthalein indicator, preferably is not greater than, with increasing preference in the order given, 50, 40, 35, 30, 25, 20, 16, 14, 12, 10.0, 9.0, 8.5, 8.0, or 7.7 points. This preferred combination of acidity conditions is most readily achieved by using a buffering agent that buffers in the acidic range in addition to the necessary components of the compositions according to the invention. When the fluorometallate anions are derived from the corresponding acids, the transition metal ions are derived from carbonates, and both necessary components are present in the composition in their preferred ratio, the pH will generally be lower than desirable unless some alkaline material is added. Ammonium hydrogen carbonate is a preferred source of such extra alkalinity, largely because of its low cost and avoidance of any danger of introducing troublesome anions into the composition, but any other source with sufficient solubility and no tendency to precipitate either of the necessary ionic constituents or interfere with the protective coating formation is suitable.

As already briefly noted, zinc ions are likely to be present in any treatment composition according to the invention after it has been used to treat zinciferous metal substrates. The concentrations of zinc ions that develop under preferred operating conditions have little or no adverse effect on the efficacy of treatment. Sulfate ions also have not been observed to have any adverse effect, at least not within the preferred ranges noted below, and thus are a suitable optional component; sulfuric acid is often added as part of the maintenance of the quality of the treatment composition and of the resultant protective coating obtained in a process according to the invention.

The treatment composition used in a process according to the invention preferably is maintained, during its period of contact with the metal substrate on which a protective coating is to be formed, at a temperature that is at least, with increasing preference in the order given, 30°, 34°, 38°, 40°, 42°, 44°, 46°, 48°, 50°, 52° or 54° C. and independently preferably is not more than, with increasing preference in the order given, 90°, 75°, 73°, 71°, 69°, 67°, 65°, 63°, 61°, or 60° C. Lower temperatures are unlikely to form satisfactory coatings in an economically acceptable time, while higher temperatures at the very least impose an unnecessary higher energy cost for maintaining such temperatures. The time of contact between a substrate surface being treated according to the invention and a treatment composition used in such a process preferably is sufficient to produce an add-on mass of the metal(s) and/or metalloid(s) present in the treatment composition in the form of fluorometallate anions as specified further below. When other conditions of the process, including the chemical constitution of the treatment composition used, are within their preferable ranges, contact times preferably are at least, with increasing preference in the order given, 0.5, 1.0, 2.0, 3.0, 4.0, or 5.0 seconds and independently, primarily for reasons of economy, preferably are not greater than, with increasing preference in the order given, 300, 200, 100, 75, 50, 40, 30, 25, 22, 19, or 16 seconds.

The adequacy of the protection achieved by a coating according to the invention can normally be effectively measured, and therefore normally preferably is measured, by determining the amounts of metal(s) and/or metalloid(s) that were present in the treatment composition in the form of fluorometallate anions as specified above and that are deposited on a unit area of the metal substrate treated during the process. The nature of the chemical bonding of the metal(s) and/or metalloid(s) in the coating is unknown, so that the add-on mass per unit area, also often called "coating weight", is most conveniently measured by some non-destructive means, such as X-ray fluorescence, that is independent of the chemical bonding of the element measured. In a process according to the invention, the amount of the electropositive elements present in the treatment composition as fluorometallate ions that is added on to the metal substrate surface treated during the process preferably is at least, with increasing preference in the order given, 1.0, 1.5, 2.0, 2.5, 3.0, or 3.5 milligrams per square meter of the surface treated (hereinafter usually abbreviated as "$mg/m^2$") and independently, primarily for reasons of economy, preferably is not more than 80, 60, 40, 35, 30, 25, 21, or 17 $mg/m^2$.

Because, under preferred operating conditions, the fluorometallate anions and the transition metal cations present in a treatment composition according to the invention deposit into the coating in a constant ratio (which often is, but need not necessarily be, the same ratio as they are present in the treatment composition), the add-on mass per unit area can also be controlled by measuring the transition metal cations incorporated into the coating instead of the electropositive element from the fluorometallate ions. This measurement also is preferably made by a technique independent of the chemical bonding of these transition metal cations in the coating. Of course, both measurements can be made to monitor the consistency of the ratio in the deposited protective coating. Ordinarily, however, measurement of the electropositive element(s) in the fluorometallate anions present in a treatment composition according to the invention provides adequate control and is more convenient.

One of the characteristics of a process according to the invention, as already noted above, is separation and disposition of a set fraction of the total treatment composition and its replacement with previously unused treatment composition. Preferably, the combination of (I) the fraction of the composition thus separated and disposed of during each instance of such separation and disposition and (ii) the time interval(s) between such instances is such that the entire volume of the treatment composition will be replenished within a time of not more than, with increasing preference in the order given, 500, 400, 300, 200, 100, 80, 60, 50, 40, 30, or 25 hours of operation of the process. Independently, the time interval between successive separations of a fraction of the total treatment composition from any part of the treatment that will be contacted thereafter with fresh metal surface to be treated is not more than, with increasing preference in the order given, 200, 100, 80, 60, 50, 40, 30, 20, 17, 15, 13, 11, 9.0, 8.0, 7.0, 6.0, 5.0, or 4.1 minutes. In principle, the most preferable method of operation would be continuous removal of a suitable fraction of the treatment composition via a metering pump or similar device, but fairly frequent removal of a set volume fraction as described immediately above appears to give fully satisfactory results and is somewhat more reliable to operate in practice, through use of commercially available process equipment intended for such a purpose.

When, as is normal, the use of at least part of a treatment composition is to be continued for a substantial period of time after the treatment composition has been prepared and used to treat its first areas of metallic surface, the volume of treatment composition removed by the repeated separation described above eventually should be effectively replenished by additional treatment composition having the same chemical characteristics as the original treatment composition before it was contacted with any metal surface to be treated. A preferred replenisher for this purpose, denoted hereinafter as a "volume" replenisher, contains transition metal cations and fluorometallate anions in the same proportions as for a freshly prepared working composition used according to the invention as described above, with the transition metal cations supplied by carbonate salts and the fluorometallate anions by their corresponding acids, and preferably no other ingredients except water.

However, the treatment process itself causes changes in the relative amounts of various components in the treatment composition, and for this reason it is preferred to use at least in part a distinct replenisher composition, denoted hereinafter as a "reaction" replenisher, that is not entirely the same in relative amounts of the ingredients as the original treatment composition. It has been found that such replenishment may be effectively accomplished by a concentrated replenisher composition that contains substantially more acidity and somewhat more fluoride in proportion to other ingredients of the composition than did the original treatment composition or a concentrate from which the original treatment composition was prepared by dilution with water only.

More particularly, in a reaction replenisher to be used according to the invention: the concentrations of fluorometallate anions and transition metal cations preferably are such that the molar ratio between them is at least, with increasing preference in the order given, 0.50:1.0, 0.80:1.0, 1.00:1.0, 1.20:1.0, 1.40:1.0, 1.60:1.0, 1.70:1.0, 1.80:1.0, 1.90:1.0, 1.95:1.0, 2.00:1.0, or 2.05:1.0 and independently preferably is not more than, with increasing preference in the order given, 10:1.0, 8.0:1.0, 6.0:1.0, 5.0:1.0, 4.5:1.0, 4.0:1.0, 3.5:1.0, 3.20:1.0, 3.00:1.0, 2.80:1.0, 2.60:1.0, 2.40:1.0, 2.20:1.0, or 2.10:1.0; and independently, a reaction replenisher composition preferably additionally comprises sulfuric acid in an amount such that the molar ratio of sulfuric acid to fluorometallate ions preferably is at least, with increasing preference in the order given, 0.25:1.0, 0.40:1.0, 0.50:1.0, 0.60:1.0, 0.70:1.0, 0.80:1.0, 0.85:1.0, 0.90:1.0, 0.95:1.0, or 1.0:1.0 and independently preferably is not more than, with increasing preference in the order given, 10:1.0, 8.0:1.0, 7.0:1.0, 6.0:1.0, 5.5:1.0, 5.0:1.0, 4.0:1.0, 3.0:1.0, 2.5:1.0, 2.2:1.0, 2.0:1.0, 1.70:1.0, 1.60:1.0, 1.50:1.0, 1.40:1.0, 1.30:1.0, 1.20:1.0, or 1.10:1.0. A reaction replenisher composition according to the invention optionally also may contain hydrofluoric acid, and if it does, the molar ratio of sulfuric to hydrofluoric acids preferably is at least, with increasing preference in the order given, 0.50:1.0, 0.80:1.0, 1.00:1.0, 1.20:1.0, 1.40:1.0, 1.60:1.0, 1.70:1.0, 1.80:1.0, 1.90:1.0, 1.95:1.0, 2.00:1.0, or 2.05:1.0. Usually, at least for reasons of economy, no hydrofluoric acid, other than that commonly found as an impurity in technical grades of fluorometallic acids, is preferred.

In some instances, especially when contact between a metal substrate and a treatment composition in a process according to the invention was primarily by immersion of the substrate in the composition or by some other method that did not achieve the direct impingement of treatment composition against the metal surface that would occur in conventional ventional spraying treatment of the metal surface, it has been found that high sulfate concentrations are deleterious to the quality of the coatings produced, particularly with respect to adhesion, and that such sulfate concentrations can occur even when the pH and the concentrations of transition metal cations and of fluorometallate anions in the a working composition used according to the invention are within their most preferred ranges. If this is observed, direct and independent measurement of the sulfate ions concentration in a working composition used according to the invention is preferred, and the concentration of sulfate ions in the treatment composition used in a process according to the invention preferably is not more than, with increasing preference in the order given, 0.40, 0.38, 0.36, 0.34, 0.32, 0.30, 0.28, 0.26, 0.24, 0.22, or 0.20% of the total composition. If unpreferredly high concentrations of sulfate are observed to recur, the chemical constitution of the reaction replenisher composition used in a process according to the invention should be changed so that the ratio of sulfuric acid to fluorometallic acid in it is lower.

When contact between the metal substrate being treated and the treatment composition in a process according to the invention is established by spraying the treatment composition onto the metal substrate instead of by immersion, concentrations of sulfate up to at least 0.8% of the total composition can usually be used without any detrimental result. When contact is primarily by spraying, however, more frequent replenishment of the treatment composition is often required than when the more common contact primarily by immersion is used.

Both types of replenisher compositions described immediately above are, in principle, most preferably added continuously, via a chemical metering pump, to the treatment composition at a rate which will maintain the most advantageous properties in a treatment composition used according to the invention as the treatment composition is used. However, inasmuch as it is not always possible to predict the requirements for such replenishment with sufficient precision to permit actually continuous replenishment, it normally is practically preferred to set an operating range for at least one particular characteristic of the treatment composition used according to the invention, to measure that characteristic frequently or most preferably continuously, to begin temporarily continuous addition of replenisher composition(s) only when the measured characteristic of the treatment composition used according to the invention passes one end of its set operating range, and to discontinue such addition when the measured characteristic reaches the opposite end of its operating range. For controlling the additions of the reaction replenisher, the most conveniently veniently measured and otherwise generally suitable characteristic of a treatment composition used according to the invention has been found to be electrical conductivity, while measurements of the transition metal cation and/or of the fluorometallate anion contents of the treatment composition have been found to be more suitable for controlling the additions of the volume replenisher.

A process according to the invention preferably is used as part of an overall process sequence including other steps that may be conventional in themselves. In particular, thorough cleaning of a surface to be treated according to the invention, before contacting this surface with the treatment liquid, a cleaning that frees the surface to be treated from oils, greases, waxes, corrosion products, and other foreign matter, is usually necessary before contacting the surface to be treated with a composition according to the invention, in order to obtain consistent high quality coatings in a process according to the invention. Such cleaning may be accomplished by methods known in the art. Thorough rinsing with water after any intermediate process step that includes contact between the metal and any material other than water and/or air, to prevent chemicals from contaminating the next treatment composition used, is also highly advantageous, as is a posttreatment, after treatment according to this invention, with an aqueous solution containing both hexavalent and trivalent chromium and optionally but preferably also containing zinc cations and hydrofluoric acid.

The invention is illustrated in greater detail below by a non-limiting working example.

EXAMPLE

In a plant processing galvanized steel coils continuously, the coils are subjected to the following process stages:

1. Spray precleaning for 2.0 seconds with an aqueous alkaline cleaner, PARCO® Cleaner 363, supplied by the Henkel Surface Technologies Division of Henkel Corp., Madison Heights, Mich. and prepared according to the supplier's directions, at a temperature of 60° to 66° C.
2. Spray water rinse for 0.5 seconds at 60°–71° C.
3. Spray first principal cleaning with an aqueous alkaline cleaner, prepared as for stage 1 above, but at a temperature of 66°–71° C. for 6.2 seconds.
4. Spray hot water rinse for 1.5 seconds at 60° to 71° C.
5. Spray hot water rinse for 1.5 seconds at 54° to 60° C.
6. Treatment with treatment composition used according to the invention; see further details below.
7. Hot water rinse by spraying for 1.5 seconds at 50°–60° C.
8. First cold water rinse by spraying for 1.0 second.
9. Second cold water rinse by spraying for 1.0 second.
10. Spray for 6.0 seconds with solutions prepared according to the supplier's directions in Technical Process Bulletin No. 350A from PARCOLENE® 62, 62R, 62RX, and/or 62RS concentrates supplied by the Henkel Surface Technologies Division of Henkel Corp., Madison Heights, Mich., except at a temperature from 49° to 71° C. (This solution contains hexavalent and trivalent chromium, zinc cations, and hydrofluoric acid.)
11. Dry to remove surface moisture.

For step 6 above, a volume of 26 kiloliters of treatment composition is initially prepared and stored in a storage tank that serves as both intake and discharge for a circuit of piping, spray nozzles, and pumps that bring the treatment composition into contact with the metal surface being treated in an area called a "reaction cell", with the metal being substantially immersed in a relatively shallow pool of the treatment composition for the period of time, often only a few seconds, while it is being treated. Therefore, although spray nozzles are used as part of the replenishment and circulation apparatus that maintains the pool of treatment composition in which the continuously moving coil is immersed, the spray does not directly impinge on the surface of the metal being treated for any more than a small fraction of the total treatment time.

The initial treatment composition is prepared by dissolving in water sufficient amounts of fluorotitanic acid, nickel carbonate, and ammonium acid carbonate to provide concentrations of 1.90 g/L of fluorotitanate anions, 0.54 g/L of nickel cations, and a pH of about 3.8. The treatment composition is maintained in the storage tank at a temperature between 54° and 60° C. and is pumped at a rate of about 4500 liters per minute through the treatment circuit as the continuous coil stock being treated is conveyed through a pool of continuously circulated treatment composition at such a rate that the surface of the coil stock is maintained in contact with the treatment composition for a total of 8.0 seconds.

The conductivity of the treatment composition is continuously monitored by a conventional measuring system that produces an electrical signal related to the conductivity. During use of the treatment composition, its pH rises and its conductivity falls because of consumption, by reaction with the metal surface being treated, of the highly conductive hydrogen/hydronium ions content of the treatment composition, which are partially replaced by less conductive zinc cations. When the conductivity value falls below a point corresponding to a pH value of 4.1 in the treatment composition, a metering pump is automatically activated and begins to pump reaction replenisher into the storage tank, by the flow induced by a pump containing circuit. This reaction replenisher is an aqueous solution containing as active ingredients, per kilogram of the total composition, only the following ingredients: 18 grams of fluotitanic acid; nickel carbonate in an amount that is stoichiometrically equivalent to 2.6 grams of nickel; 10 grams of sulfuric acid; and 1.0 gram of hydrofluoric acid. When the conductivity reaches a value corresponding to a pH of 3.8, flow of the reaction replenisher into the storage tank is discontinued until the conductivity value falls again below the value corresponding to a pH of 4.1 in the treatment composition.

Concentrations of titanium in the treatment composition are monitored intermittently by manually removing at least 5 milliliter samples from the treatment composition and measuring suring the concentration of titanium in a 5 milliliter portion of the sample thus removed. This measurement is made according to the directions of and using a sample cup and a PORTASPECTM™ Model 2501 X-ray spectrograph supplied by Cianflone Scientific. When the concentration of titanium as thus measured falls below 550 parts per million (hereinafter usually abbreviated as "ppm"), volume replenisher is added to the storage tank until the measured titanium concentration rises to 650 ppm and is then discontinued until the titanium concentration as thus measured falls below 550 ppm again. The volume replenisher is an aqueous solution containing as active ingredients, per kilogram of the total replenisher, only the following ingredients: 19 grams of fluorotitanic acid and an amount of nickel carbonate that is stoichiometrically equivalent to 2.6 grams of nickel. It has been found that this method is effective for maintaining both the nickel and titanium concentrations within the desired ranges for the level of coating quality consistency required.

Independently of the measurements of conductivity and titanium concentrations, an automatically controlled discharge mechanism is activated every four minutes during use of the treatment composition so as to cause the discharge of about 60 liters of the total treatment composition. Volume thus discharged is not returned to the storage tank or to the circuit containing treatment solution that is sprayed on the metal substrate being treated; instead, this volume is usually discharged as waste after appropriate pollution abatement. (The solution could be separated into its components and recycled in that manner to the process, but under current conditions such measures would be uneconomical.) The volume thus discharged is made up by additions of reaction replenisher and volume replenisher as described above.

The concentration of sulfate ions in the process solution is also measured at regular intervals by using sulfate test indicator paper on a small sample of the process solution removed from the bulk of the process solution and diluted to five times its initial volume with water. If this measurement indicates that the sulfate concentration in the process solution has exceeded 0.20% by weight of the process solution, a special removal of about one third of the total volume of the process solution is performed as soon as practically possible thereafter, and the removed volume is replaced with volume replenisher.

Continuous operation in this manner produces consistently high quality coatings containing about 10 mg/$M^2$ of titanium.

The invention claimed is:

1. A process of forming, over a specified period of time, a protective coating on one or more zinciferous surface(s) by contacting the surface(s) with at least a portion of a specified total volume of an aqueous liquid treatment composition comprising water, transition metal cations, and fluorometallate anions, said process including steps of:

(I) measuring a pH value of, a transition metal cations concentrations in, and a fluorometallate anions concentrations in, the specified total volume of treatment composition as it is used;

(II) at at least one specified time after beginning use of the specified total volume of the treatment composition, said specified time being within said specified period of time over which the process is operated and being not more than 200 minutes, and, if the specified period of time is at least 400 minutes, also at one or more successive times thereafter, removing a specified fraction of the total volume of the treatment composition from contact with the remainder of the total volume of the treatment composition, said one or more successive times thereafter being selected so that not more than 200 minutes elapses between any such successive time and a most nearly preceding time at which a specified total fraction of the specified total volume of the treatment composition has been removed from contact with the remainder of the specified total volume of the treatment composition, said specified fraction or fractions of the specified total volume of the treatment being selected so that a ratio of said specified period of time, measured in hours, to a sum of all said specified fraction or fractions of the specified total volume that are removed from contact with the remainder of the specified total volume during said period of time has a numerical value not greater than 100; and (III) adding one or more suitable replenisher compositions to the treatment composition, in order to maintain the pH value of the composition, the transition metal cations concentration of the composition, and the fluorometallate anions concentrations of the composition within respectively specified ranges for each of the pH value, the transition metal cations concentration, and the fluorometallate anions concentration.

2. A process according to claim 1, wherein the aqueous liquid treatment composition has a pH value from about 2.5 to about 5.0, a concentration of transition metal cations that is from about 0.0004 to about 0.050 M/L, a concentration of fluorometallate anions that is from about 0.001 to about 0.20 M/L, and a ratio of the concentration of fluorometallate anions to the concentration of transition metal cations, both measured in the same units, that is from about 0.50:1.0 to about 10:1.0.

3. A process according to claim 2, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 0.5:1.0 to about 10:1.0 and the molar concentration of sulfuric acid has a ratio to the molar concentration of fluorometallate ions that is from about 0.25:1.0 to about 10:1.0.

4. A process according to claim 3, wherein the aqueous liquid treatment composition has a pH value from about 2.9 to about 5.0, a concentration of transition metal cations that is from about 0.0008 to about 0.050 M/L, a concentration of fluorometallate anions that is from about 0.002 to about 0.10 M/L, a ratio of the concentration of fluorometallate anions to the concentration of transition metal cations, both measured in M/L, that is from about 0.80:1.0 to about 8.0:1.0, and a concentration of sulfuric acid that corresponds stoichiometrically to a concentration of sulfate ions that is greater than zero but not more than 0.40% of the total composition, and the zinciferous surface is immersed in a volume of aqueous liquid treatment composition in order to contact it.

5. A process according to claim 4, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 0.80:1.0 to about 8.0:1.0 and the molar concentration of sulfuric acid has a ratio to the molar concentration of fluorometallate ions that is from about 0.40:1.0 to about 7.0:1.0.

6. A process according to claim 5, wherein the aqueous liquid treatment composition has a pH value from about 3.1 to about 4.8, a concentration of transition metal cations that is from about 0.0015 to about 0.030 M/L, a concentration of fluorometallate anions that is from about 0.004 to about 0.070 M/L, a ratio of the concentration of fluorometallate anions to the concentration of transition metal cations, both measured in M/L, that is from about 1.20:1.0 to about 5.0:1.0, and a concentration of sulfuric acid that corresponds stoichiometrically to a concentration of sulfate ions that is greater than zero but not more than 0.36% of the total composition.

7. A process according to claim 6, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 1.00:1.0 to about 6.0:1.0 and the molar concentration of sulfuric acid has a ratio to the molar concentration of fluorometallate ions that is from about 0.50:1.0 to about 6.0:1.0.

8. A process according to claim 7, wherein the aqueous liquid treatment composition has a pH value from about 3.3 to about 4.6, a concentration of transition metal cations that is from about 0.0020 to about 0.020 M/L, a concentration of fluorometallate anions that is from about 0.006 to about 0.040 M/L, a ratio of the concentration of fluorometallate anions to the concentration of transition metal cations, both measured in M/L, that is from about 1.60:1.0 to about 4.0:1.0, and a concentration of sulfuric acid that corresponds stoichiometrically to a concentration of sulfate ions that is greater than zero but not more than 0.32% of the total composition.

9. A process according to claim 8, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 1.20:1.0 to about 5.0:1.0 and the molar concentration of sulfuric acid has a ratio to the molar concentration of fluorometallate ions that is from about 0.60:1.0 to about 4.0:1.0.

10. A process according to claim 9, wherein the aqueous liquid treatment composition has a pH value from about 3.5 to about 4.4, a concentration of transition metal cations that is from about 0.0020 to about 0.015 M/L, a concentration of fluorometallate anions that is from about 0.0070 to about 0.035 M/L, a ratio of the concentration of fluorometallate anions to the concentration of transition metal cations, both measured in M/L, that is from about 1.80:1.0 to about 4.0:1.0, and a concentration of sulfuric acid that corresponds stoichiometrically to a concentration of sulfate ions that is greater than zero but not more than 0.30% of the total composition.

11. A process according to claim 10, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 1.40:1.0 to about 4.0:1.0 and the molar concentration of sulfuric acid has a ratio to the molar concentration of fluorometallate ions that is from about 0.70:1.0 to about 3.0:1.0.

12. A process according to claim 11, wherein the aqueous liquid treatment composition has a pH value from about 3.60 to about 4.4, a concentration of transition metal cations that is from about 0.0030 to about 0.0100 M/L, a concentration of fluorometallate anions that is from about 0.0090 to about 0.022 M/L, a ratio of the concentration of fluorometallate anions to the concentration of transition metal cations, both measured in M/L, that is from about 2.10:1.0 to about 3.20:1.0, and a concentration of sulfuric acid that corresponds stoichiometrically to a concentration of sulfate ions that is greater than zero but not more than 0.26% of the total composition.

13. A process according to claim 12, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 1.70:1.0 to about 3.20:1.0 and the molar concentration of sulfuric acid has a ratio to the molar concentration of fluorometallate ions that is from about 0.85:1.0 to about 2.0:1.0.

14. A process according to claim 13, wherein the aqueous liquid treatment composition has a pH value from about 3.80 to about 4.20, a concentration of transition metal cations that is from about 0.0042 to about 0.0057 M/L, a concentration of fluorometallate anions that is from about 0.0105 to about 0.0125 M/L, a ratio of the concentration of fluorometallate anions to the concentration of transition metal cations, both measured in M/L, that is from about 2.40:1.0 to about 2.80:1.0, and a concentration of sulfuric acid that corresponds stoichiometrically to a concentration of sulfate ions that is greater than zero but not more than 0.20% of the total composition.

15. A process according to claim 14, wherein at least one replenisher composition added during step (III) comprises water, a molar concentration of transition metal cations, a molar concentration of fluorometallate anions, and a molar concentration of sulfuric acid, all of said molar concentrations having values such that the molar concentration of fluorometallate anions has a ratio to the molar concentration of transition metal cations that is from about 1.95:1.0 to about 2.20:1.0 and the molar concentration of sulfuric acid has a ratio to the molar concentration of fluorometallate ions that is from about 0.95:1.0 to about 1.20:1.0.

16. A process according to claim 15, wherein the transition metal cations are selected from the group consisting of nickel, cobalt, copper, iron, and manganese and the fluorometallate anions are selected from the group consisting of fluoroborate, fluorosilicate, fluorotitanate, and fluorozirconate anions.

17. A process according to claim 16, wherein the transition metal cations are selected from the group consisting of nickel, cobalt, and iron and the fluorometallate anions are selected from the group consisting of fluorotitanate and fluorozirconate anions.

18. A process according to claim 17, wherein the transition metal cations are nickel and the fluorometallate anions are fluorotitanate anions.

19. A process according to claim 1, wherein the transition metal cations are selected from the group consisting of nickel, cobalt, copper, iron, and manganese and the fluorometallate anions are selected from the group consisting of fluoroborate, fluorosilicate, fluorotitanate, and fluorozirconate anions.

20. A process according to claim 19, wherein the transition metal cations are selected from the group consisting of nickel, cobalt, and iron and the fluorometallate anions are selected from the group consisting of fluorotitanate and fluorozirconate anions.

* * * * *